US008790454B2

(12) United States Patent
Lee et al.

(10) Patent No.: US 8,790,454 B2
(45) Date of Patent: Jul. 29, 2014

(54) HEAT EXCHANGER HAVING DEHUMIDIFYING LIQUID AND DEHUMIDIFIER HAVING THE SAME

(75) Inventors: Dae-Young Lee, Seoul (KR); Seo Young Kim, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 349 days.

(21) Appl. No.: 13/213,296

(22) Filed: Aug. 19, 2011

(65) Prior Publication Data

US 2012/0256330 A1 Oct. 11, 2012

(30) Foreign Application Priority Data

Apr. 5, 2011 (KR) ..... 10-2011-0031394

(51) Int. Cl.

| | |
|---|---|
| ***B01D 53/14*** | (2006.01) |
| ***B01F 3/04*** | (2006.01) |
| ***F28F 3/00*** | (2006.01) |

(52) U.S. Cl.

USPC ..... 96/290; 165/166; 261/112.2

(58) Field of Classification Search

USPC ..... 261/112.2; 95/228; 96/243, 290; 165/166

See application file for complete search history.

(56) References Cited

U.S. PATENT DOCUMENTS

2011/0073290 A1* 3/2011 Chang et al. ..... 165/133

FOREIGN PATENT DOCUMENTS

| | | |
|---|---|---|
| JP | 2005-024187 | 1/2005 |
| KR | 10-2010-0094163 | 8/2010 |
| KR | 10-2011-0029513 | 3/2011 |
| KR | 10-2011-0030980 | 3/2011 |

OTHER PUBLICATIONS

Korean Office Action issued Aug. 20, 2012 in counterpart Korean Patent Application No. 10-2011-0031394 (4 pages, in Korean).

* cited by examiner

*Primary Examiner* — Robert A Hopkins
(74) *Attorney, Agent, or Firm* — NSIP Law

(57) ABSTRACT

A heat exchanger having an extended surface plate includes a plurality of heat exchanging bodies having therein flow paths along which a heat transfer medium flows, and extended surface plates each disposed between the heat exchanging bodies and having inclined surfaces in horizontal and vertical directions. Also disclosed is a dehumidifier having the heat exchanger. Moisture in the air may be effectively absorbed by a dehumidifying liquid, and the heat exchanger may have enhanced structural strength.

9 Claims, 8 Drawing Sheets

HEAT EXCHANGER HAVING DEHUMIDIFYING LIQUID AND DEHUMIDIFIER HAVING THE SAME

CROSS-REFERENCE TO RELATED APPLICATION

Pursuant to 35 U.S.C. §119(a), this application claims the benefit of earlier filing date and right of priority to Korean Application No. 10-2011-0031394, filed on Apr. 5, 2011, the contents of which is incorporated by reference herein in its entirety.

BACKGROUND OF THE INVENTION

1. Field of the Invention

This specification relates to a liquid type dehumidifying apparatus, and particularly, to a heat exchanger having an extended surface plate capable of effectively absorbing moisture from the air by using a dehumidifying liquid, and capable of having enhanced rigidity, and a liquid type dehumidifier having the same.

2. Background of the Invention

Generally, a liquid type dehumidifier serves to obtain dry air by absorbing moisture in the air by spraying a dehumidifying liquid of a high concentration to the air. This liquid type dehumidifier is configured to perform consecutive dehumidifying operations by circulating the dehumidifying liquid sprayed into the air to be dried. Here, the dehumidifying liquid having absorbed moisture in the air has a low concentration, thereby having a low hygroscopic property in the next cycle. To prevent this, the dehumidifying liquid which has become diluted after absorbing moisture is re-sprayed into the air of a high temperature, thereby having moisture evaporated therefrom at a high temperature atmosphere. This process is called 'regeneration', and is performed in a regenerator.

For enhanced dehumidifying efficiency, the dehumidifying liquid and the air to which the dehumidifying liquid is sprayed preferably have low temperatures. Furthermore, a contact area between the dehumidifying liquid and the air is preferably increased. For enhanced regenerating efficiency, the dehumidifying liquid and the air to which the dehumidifying liquid is sprayed preferably have high temperatures, and a contact area is preferably increased. In order to operate this liquid type dehumidifier, the dehumidifying liquid and the air have to be heated (regenerating process) or cooled (dehumidifying process). To this end, a heat exchanger is used. More concretely, a dehumidifying liquid is sprayed onto the surface of a heat exchanger in which a heat medium of a high temperature of a low temperature flows so that the dehumidifying liquid can flow along the surface of the heat exchanger. And, air is sprayed onto the heat exchanger so that the air and the dehumidifying liquid can be cooled or heated by being heat-exchanged with the heat medium which flows in the heat exchanger. In order to cool or heat a larger amount of dehumidifying liquid for a unitary time, a larger amount of dehumidifying liquid has to be firstly supplied. However, in this case, the dehumidifying liquid may form a thick liquid film on the surface of the heat exchanger. This may lower a heat and mass transfer coefficient. Furthermore, when a thick liquid film is formed on the surface of the heat exchanger, waves may be formed on the surface of the liquid film or the liquid film may become unstable. This may cause the liquid film to be dispersed to the supplied air.

FIG. 1 illustrates an example of the heat exchanger. Referring to FIG. 1, the heat exchanger 10 has a structure in which a plurality of heat exchanging bodies 12 are disposed in parallel. Cooling water or heating water for heat exchange flows to an inner space of each heat exchanging body 12. The inner space is divided into a plurality of channels by partition walls 14. A dehumidifying liquid is supplied to upper parts of the heat exchanging bodies 12, and downward flows along the surfaces of the heat exchanging bodies 12 by gravitation. Air to be dehumidified or regenerating air is supplied to a space between the heat exchanging bodies 12.

Under this configuration, the dehumidifying liquid and the air are heated or cooled to enhance dehumidifying efficiency or regenerating efficiency. In order to enhance heat transfer efficiency, the dehumidifying liquid has to be uniformly supplied onto the surfaces of the heat exchanging bodies 12. And, the liquid film formed on the surface of the heat exchanger has to have a thin thickness. This is may increase a heat transfer amount to the air, and may prevent the dehumidifying liquid from being dispersed to the air.

The dehumidifying liquid and the air are heat-exchanged only on the surfaces of the heat exchanging bodies 12. This may cause the heat exchanger to have a large size. Furthermore, a heat transfer amount per unitary time is decreased due to a limited thickness of the liquid film.

To prevent this, as shown in FIG. 2, the present inventor has devised a structure in which each of extended surface plates 50 is disposed in a zigzag form between the heat exchanging bodies 12. This may prolong time taken for a dehumidifying liquid supplied from the upper side to stay between the two heat exchanging bodies, thereby enhancing contact efficiency.

However, as shown in FIG. 3, when the extended surface plates 50 are not installed in a completely horizontal state, a dehumidifying liquid may be collected to a lower side along an inclination in spite of a very small gradient. This may cause the dehumidifying liquid not to uniformly spread onto the surfaces of the extended surface plates 50. As a result, a contact area between the dehumidifying liquid and the air is decreased, and dehumidifying efficiency is degraded.

The extended surface plate 50 is formed of nonwoven fabric so that a dehumidifying liquid can be easily soaked thereto. However, when the nonwoven fabric has a wet surface by the dehumidifying liquid, an intensity of the extended surface plate may be degraded due to a weight of the dehumidifying liquid. This may cause the extended surface plate extending in parallel between the heat exchanging bodies to have a downward deformed center as shown in FIG. 2. Furthermore, the dehumidifying liquid may be collected in the downward deformed center, not on the entire surface of the extended surface plate. As a result, heat exchange efficiency between the dehumidifying liquid and the air may be lowered.

In order to solve this problem, the extended surface plate 50 is made to maintain a complete horizontal state, or an additional reinforcing structure is adopted, or a material having a higher intensity is used. However, this may cause the entire structure to become complicated, or degrade a wet property.

SUMMARY OF THE INVENTION

Therefore, an aspect of the detailed description is to provide a heat exchanger having a dehumidifying liquid and a dehumidifier having the same, the heat exchanger capable of having an extended surface plate of a high intensity, and capable of uniformly supplying a dehumidifying liquid supplied from an upper side to the surface of the extended surface plate regardless of an installation gradient of the extended surface plate.

To achieve these and other advantages and in accordance with the purpose of this specification, as embodied and broadly described herein, a heat exchanger having an extended surface plate includes a plurality of heat exchanging bodies having therein flow paths along which a heat transfer medium flows, and extended surface plates each disposed to contact facing surfaces of the heat exchanging bodies, and configured to allow a dehumidifying liquid supplied between the heat exchanging bodies to flow therealong, wherein when a supply direction of the dehumidifying liquid is a vertical direction, the extended surface plate has a zigzag-form in the vertical direction, and has a plurality of bending portions in a horizontal direction.

The extended surface plate may be formed to have a plurality of bending is portions in a horizontal direction, rather than to have the conventional linear shape. This may enhance an intensity against vertical deformation. The bending portions may be configured to have a corrugated form or a zigzag form.

The extended surface plate may be formed of nonwoven fabric. For instance, the extended surface plate may be formed of polyethyleneterephthalate (PET) nonwoven fabric.

For enhanced spreading of the dehumidifying liquid, the heat exchanging bodies may undergo a surface processing for enhanced wet property. Alternatively, a surface of the extended surface plate may undergo hydrophilic coating.

The extended surface plate may be provided with a plurality of passing holes through which a dehumidifying liquid supplied from an upper side flows down. At least one of the passing holes may be formed on a bottom surface of the bending portion where the dehumidifying liquid is collected by gravitational force.

The present invention may have the following advantages.

Firstly, a dehumidifying liquid may be uniformly supplied onto the surface of the extended surface plate regardless of an installation gradient of the extended surface plate.

Secondly, an intensity of the extended surface plate against vertical deformation may be enhanced without using an additional reinforcing structure or without changing a material of the extended surface plate. This may enhance heat exchanging efficiency between the dehumidifying liquid and the air.

Further scope of applicability of the present application will become more apparent from the detailed description given hereinafter. However, it should be understood that the detailed description and specific examples, while indicating preferred embodiments of the invention, are given by way of illustration only, since is various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a heat exchanger having an extended surface plate according to the present invention will be explained in more details with reference to the attached drawings.

Figure 1:
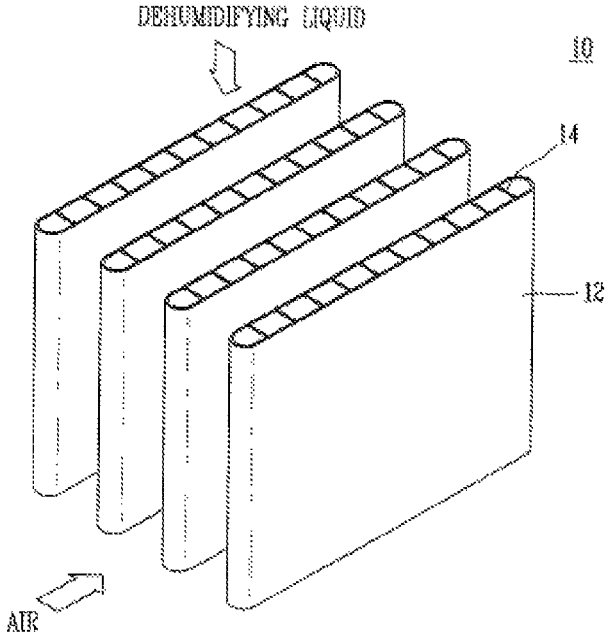
FIG. 1 is a perspective view illustrating one example of a heat exchanger in accordance with the conventional art.
Figure 2:
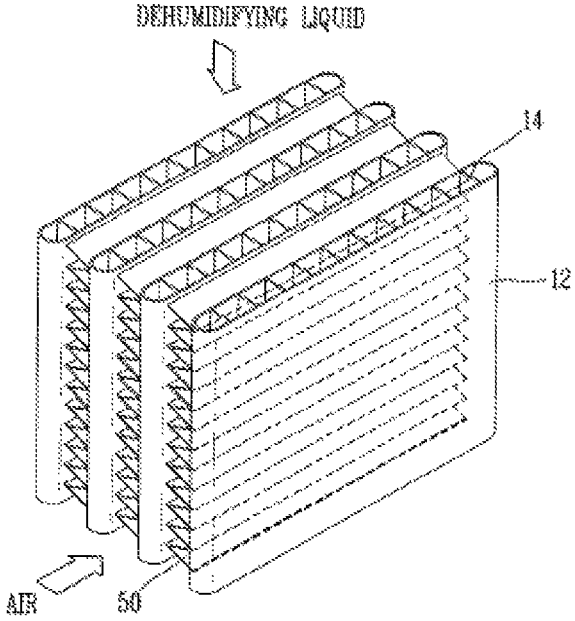
FIG. 2 is a perspective view illustrating another example of a heat exchanger in accordance with the conventional art.
Figure 3:
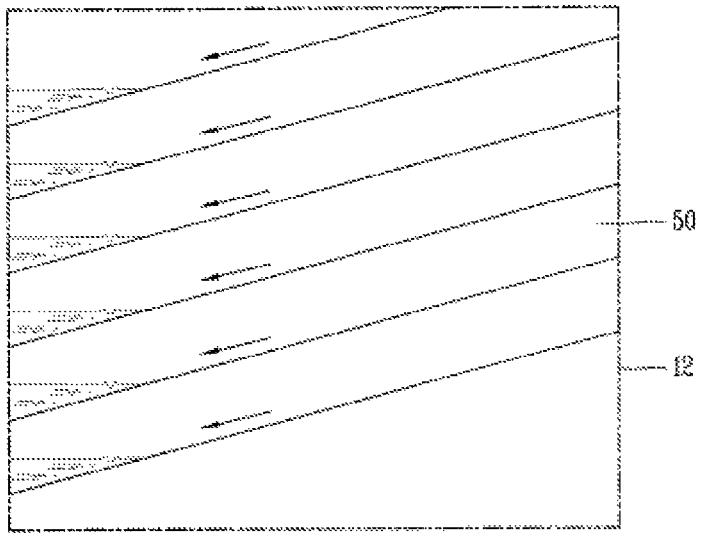
FIG. 3 is a frontal view of a heat exchanger in which an extended surface plate is installed with inclination in accordance with the conventional art.
Figure 4:
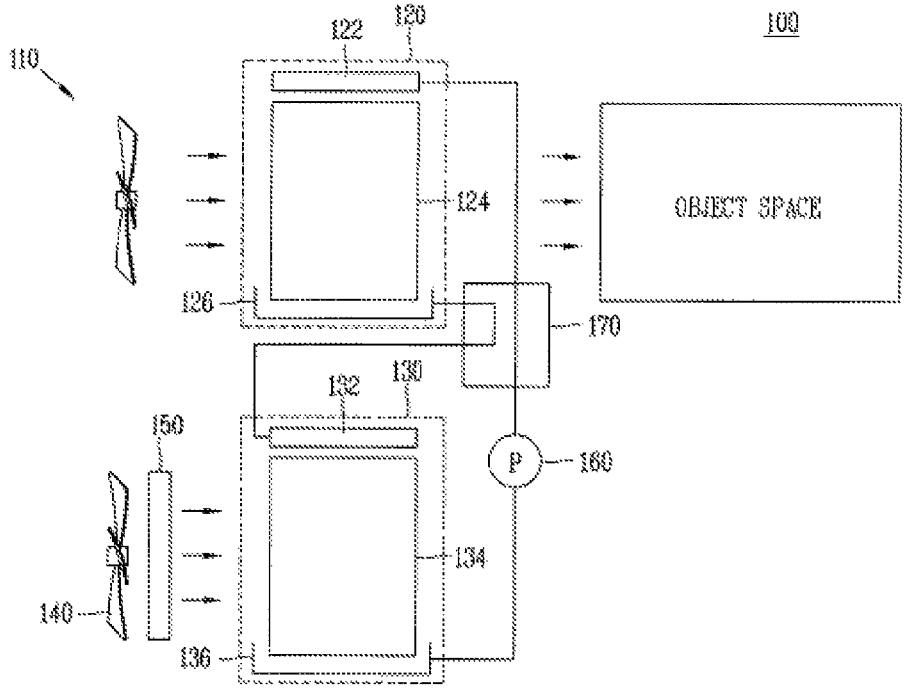
FIG. 4 is a view illustrating a configuration of a liquid type dehumidifier to which a heat exchanger having an extended surface plate according to one embodiment of the present invention has been applied.

Referring to FIG. 4, a heat exchanger according to the present invention comprises a plurality of heat exchanging bodies 200, and an extended surface plate 300 disposed between the heat exchanging bodies 200. The heat exchanger may be a first heat exchanger 124 or a second heat exchanger disclosed in FIG. 4 or to be disclosed in the following descriptions.

The heat exchanging bodies 200 are disposed upright in parallel, and a predetermined space is formed therebetween. A flow path 210 along which a heat exchanging medium flows is penetratingly formed at each of the heat exchanging bodies 200 in upper and lower directions.

The extended surface plate 300 is formed in plurality in number, and each extended surface plate 300 is disposed between the heat exchanging bodies 300.

Some of a dehumidifying liquid supplied from the upper side downward flows along surfaces of the heat exchanging bodies 200. And, the rest of the dehumidifying liquid downward flows along surfaces of the extended surface plates 300 and comes in contact with air, thereby performing a heat exchanging function.

Referring to FIGS. 5 to 13, will be explained configurations of the extended surface plates 300 and 400 capable of increasing a heat transfer area between the dehumidifying liquid and the air.

The extended surface plates 300 and 400 are disposed between the heat exchanging bodies 200, and are configured to have a corrugated form in a horizontal direction (Z-axis) but to have a zigzag form in a vertical direction (Y-axis). The extended surface plates 300 and 400 may be formed of polyethyleneterephthalate (PET) nonwoven fabric.

Figure 6:
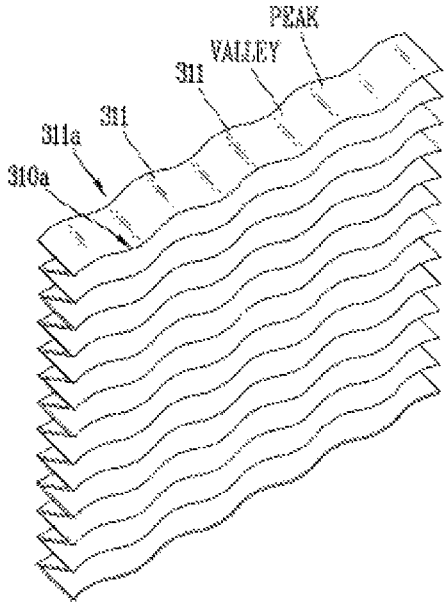
FIG. 6 is a perspective view illustrating the extended surface plate of FIG. 4.

Referring to FIG. 6, the extended surface plate 300 is configured to have a zigzag form in a vertical direction, upper and lower directions of the heat exchanging bodies 200, i.e., a folded form in a Z-shape. Here, the extended surface plate 300 consists of first inclination surfaces 310 having a zigzag form in upper and lower directions when viewed from the side of the heat exchanging body 200.

The extended surface plate 300 may be configured to have a curvature such as a sine wave form in a horizontal direction, and may have a plurality of valleys and peaks with a predetermined interval therebetween.

Accordingly, each of the first inclination surfaces 310 formed in a horizontal direction and having an end portion folded in a zigzag form may have a corrugated surface having a predetermined width in a horizontal direction.

Once a dehumidifying liquid is supplied from an upper side of the extended surface plate 300 in a state that air flows in a horizontal direction of the extended surface plate 300 from the side of the heat exchanging body 200, the dehumidifying liquid is supplied to an uppermost first inclination surface 310 thus to flow along a plurality of valleys of the uppermost first inclination surface 310. Then, the dehumidifying liquid collected in the plurality of valleys may spread to peaks connected to the valleys according to a capillary phenomenon.

According to one example of the extended surface plate 300, the dehumidifying liquid may uniformly spread to corrugated surfaces (or extended surfaces) of the first inclination surfaces 310 in a horizontal direction regardless of a horizontal gradient of the first inclination surfaces 310.

The extended surface plate 300 is configured to be folded in a zigzag form in a vertical direction, and to have a curvature in a corrugated form in a horizontal direction. This configuration may allow the extended surface plate 300 to have an intensity high enough to endure downward deformation due to a dehumidifying liquid. Accordingly, an interval between the extended surfaces may be constantly maintained.

Figure 8:
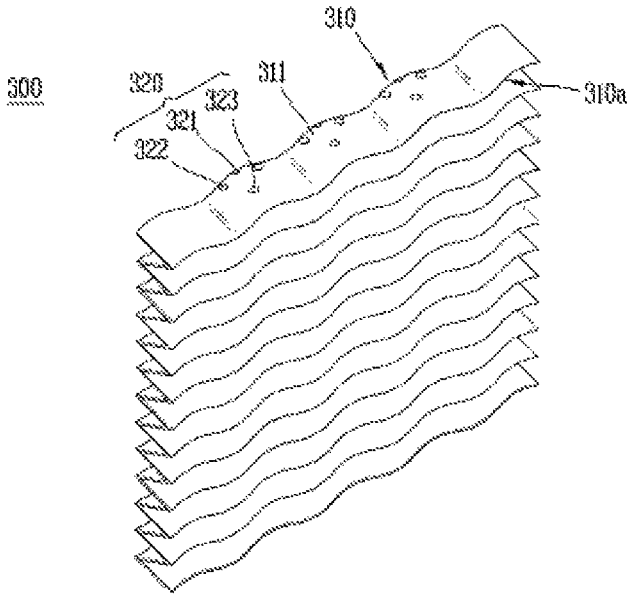
FIG. 8 is a perspective view illustrating that passing holes are formed at the extended surface plate of FIG. 6.
Figure 9:
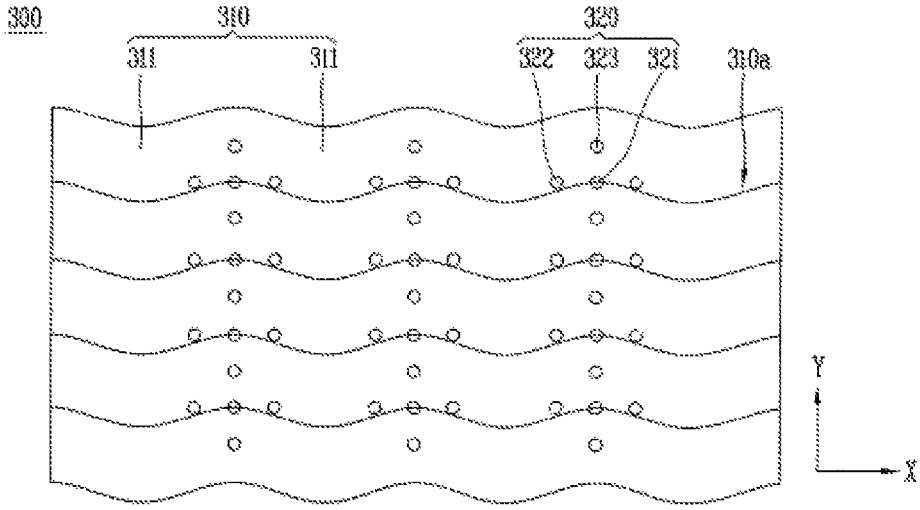
FIG. 9 is an unfolded view of the extended surface plate of FIG. 8.

Referring to FIGS. 8 and 9, each corrugated surface of the first inclination surfaces 310 is provided with a plurality of passing holes 320. Some of the passing holes 320 may be formed to contact the surface of the heat exchanging body 200, and others of the passing holes 320 may be formed to be exposed to the surface of the heat exchanging body 200. And, the others of the passing holes 320 may be formed in the first inclination surface 310. Through the passing holes 320, a dehumidifying liquid downward flows. The passing holes 320 will be explained in more details in the following descriptions.

Figure 10:
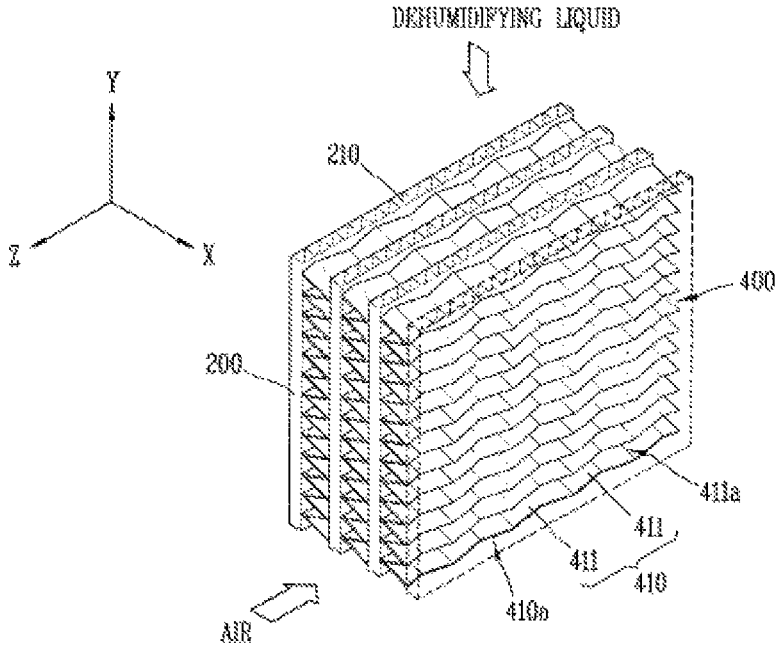
FIG. 10 is a perspective view illustrating a heat exchanger to which an extended surface plate according to another embodiment of the present invention has been applied.
Figure 11:
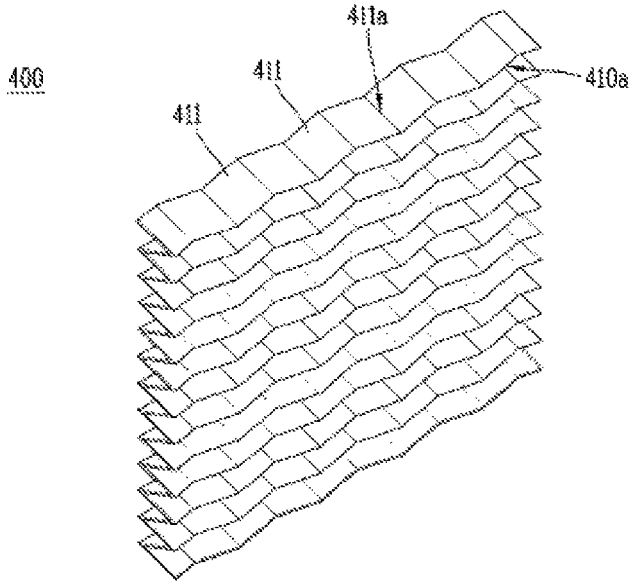
FIG. 11 is a perspective view illustrating the extended surface plate of FIG. 10.
Figure 12:
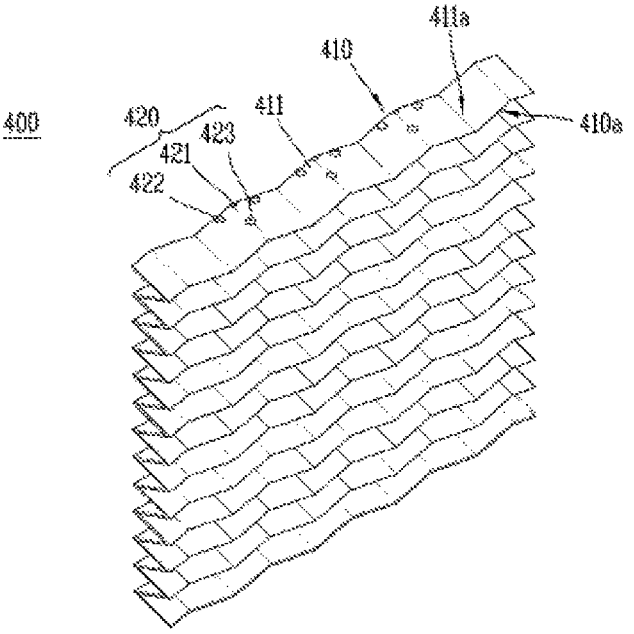
FIG. 12 is a perspective view illustrating that passing holes are formed at the extended surface plate of FIG. 11.
Figure 13:
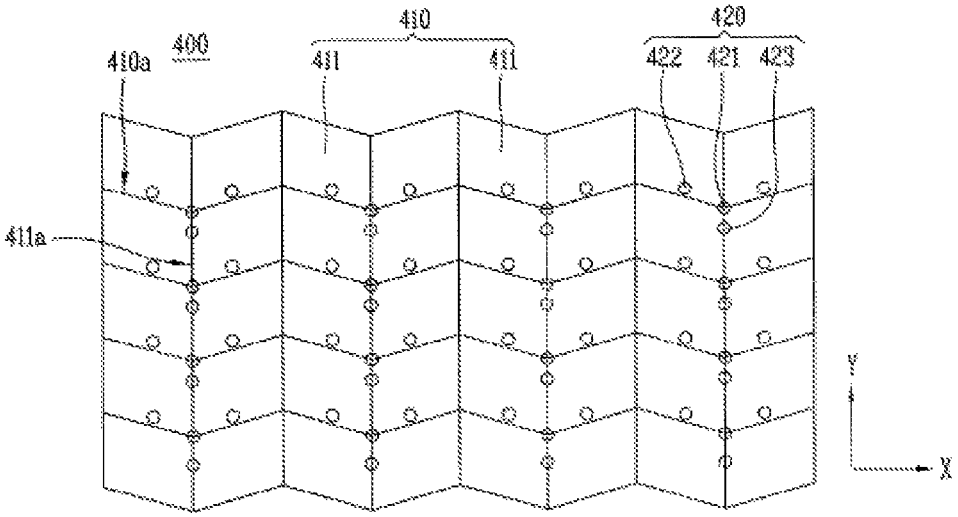
FIG. 13 is an unfolded view of the extended surface plate of FIG. 11.

FIG. 10 is a view illustrating another example of the extended surface plate 400 according to the present invention.

Referring to FIG. 10, the extended surface plate 400 is configured to have a zigzag form in a vertical direction, upper and lower directions of the heat exchanging bodies 200, i.e., a folded form in a Z-shape. Here, the extended surface plate 400 consists of second inclination surfaces 410 having a zigzag form in upper and lower directions when viewed from the side of the heat exchanging body 200.

The extended surface plate 400 is configured to be folded in a zigzag-form in a horizontal direction of the heat exchanging body 200. Accordingly, the extended surface plate 400 may be configured to have end portions folded in a zigzag-form in vertical and horizontal directions.

Each of second inclination surfaces 410 folded in a zigzag-form in a vertical direction may consist of surfaces 411 bent in a zigzag-form in a horizontal direction.

Once a dehumidifying liquid is supplied from an upper side of the extended surface plate 400 in a state that air flows in a horizontal direction of the extended surface plate 400 from the side of the heat exchanging body 200, the dehumidifying liquid is supplied to the surfaces 411 of an uppermost second inclination surface 410 thus to flow along the surfaces. Then, the dehumidifying liquid may be collected in a plurality of valleys formed between the surfaces 411. Then, the dehumidifying liquid may spread to edge portions connected to the valleys according to a capillary phenomenon. Here, the edge portion indicates a part having a conical shape as the surfaces 411 are connected to each other.

According to another example of the extended surface plate 400, the dehumidifying liquid may uniformly spread to the surfaces 411 (or extended surfaces) of the second inclination surfaces 410 in a horizontal direction regardless of a horizontal gradient of the second inclination surfaces 410.

The extended surface plate 400 is configured to be folded in a zigzag shape in vertical and horizontal directions. This configuration may allow the extended surface plate 400 to have an enhanced intensity. Accordingly, an interval between the extended surfaces may be constantly maintained even if the dehumidifying liquid is supplied.

Each surface 411 of the second inclination surfaces 410 is provided with a plurality of passing holes 420. Some of the passing holes 420 may be formed to contact the surface of the heat exchanging body 200, and others of the passing holes 420 may be formed to be exposed to the surface of the heat exchanging body 200. And, the others of the passing holes 420 may be formed in the second inclination surface 410. Through the passing holes 420, a dehumidifying liquid downward flows.

Hereinafter, will be explained a liquid type dehumidifier having the heat exchanger to which the extended surface plate has been applied.

Referring to FIG. 4, the dehumidifier of the present invention comprises a first blowing fan 110 configured to suck external air and to supply the external air into a system. The external air sucked by the first blowing fan 110 is blown to a first heat exchanging module 120. The first heat exchanging module 120 serves to remove moisture included in external air by contacting the external air with a dehumidifying liquid. Above the first heat exchanging module 120, positioned is an upper header 122 configured to downward supply a dehumidifying liquid. Below the upper header 122, disposed is a first heat exchanger 124. External air having passed through the first heat exchanging module 120 has moisture removed therefrom by a dehumidifying liquid, and then is moved to an object space.

The dehumidifying liquid supplied from the upper header 122 comes in contact with the sucked external air while flowing along the surface of the first heat exchanger 124. In this process, the dehumidifying liquid absorbs moisture included in the external air. Here, the dehumidifying liquid and the external air are cooled due to heat exchange with cooling water supplied into the first heat exchanger 124. This may enhance dehumidifying efficiency. As the cooling water, may be used cooling water supplied from an external water source or cooling water cooled by an additional cooling device, and so on.

The dehumidifying liquid having passed through the first heat exchanger 124 is collected in a lower header 126 disposed below the first heat exchanger 124. Then, the collected dehumidifying liquid is supplied into an upper header 132 of a second heat exchanging module 130. The second heat exchanging module 130 serves to enhance a hygroscopic property by concentrating the dehumidifying liquid having moisture obtained from the first heat exchanging module 120. And, the second heat exchanging module 130 includes a second heat exchanger 134 similar to the first heat exchanger 124.

A second blowing fan 140 configured to supply hot air to the second heat exchanger 134 is disposed near the second heat exchanger 134. A heater 150 configured to heat air may be disposed between the second blowing fan 140 and the second heat exchanger 134. The supplied hot air comes in contact with the dehumidifying liquid on the second heat exchanging module 130, thereby concentrating the dehumidifying liquid. Differently from the first heat exchanger 124, the second heat exchanger 134 is supplied with hot water to accelerate evaporation of moisture.

The dehumidifying liquid having passed through the second heat exchanger 134 is collected in a lower header 136 disposed below the second heat exchanger 134. Then, the collected dehumidifying liquid is supplied into an upper header 132 by a pump 160. Here, a sensible heat exchanger 170 may be additionally installed to enhance heat efficiency by performing heat exchange between circulated dehumidifying liquids. More concretely, a dehumidifying liquid which moves to the second heat exchanging module 130 from the first heat exchanging module 120 in the sensible heat exchanger 170 performs a heat exchanging function with a dehumidifying liquid which moves to the first heat exchanging module 120 from the second heat exchanging module 130, thereby reducing energy required to cool or heat the dehumidifying liquid.

Figure 5:
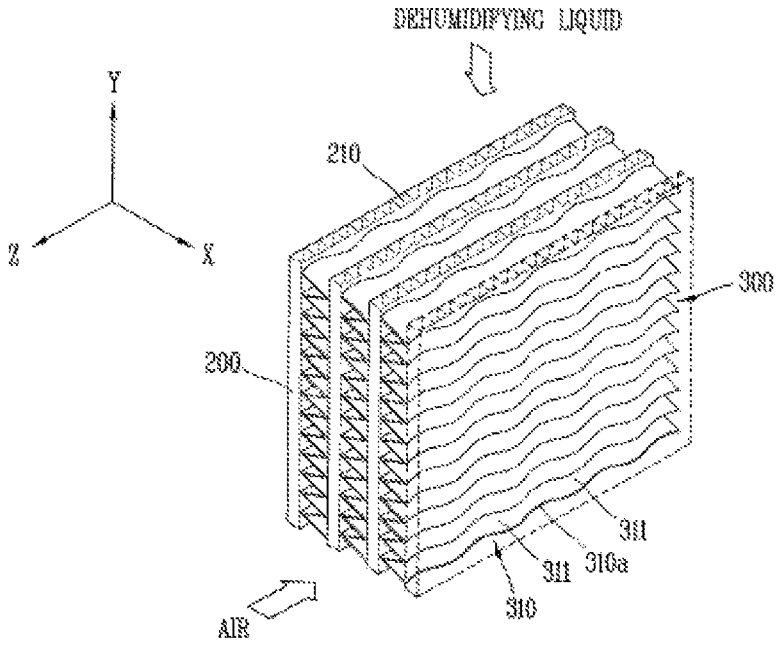
FIG. 5 is a perspective view illustrating the heat exchanger of FIG. 4.

FIG. 5 illustrates a structure of the first heat exchanger 124. The second to heat exchanger 134 has the same configuration as the first heat exchanger 124, and thus its detailed explanations will be omitted.

The first heat exchanger 124 includes a plurality of heat exchanging bodies 200 disposed upright in parallel with a predetermined interval therebetween. A heat transfer medium such as cooling water supplied from the outside flows into the heat exchanging bodies 200 along a flow path 210 formed in a lengthwise direction of the heat exchanging bodies 200. The heat transfer medium performs a heat exchanging function with the dehumidifying liquid which flows along the surfaces of the heat exchanging bodies 100 or the air, thereby cooling the dehumidifying liquid or the air. The heat exchanging bodies 200 may be formed of a material having an anti-corrosion property so as to endure high corrosiveness of the dehumidifying liquid. In the present invention, the heat exchanging bodies 200 may be formed of a plastic polymer, polypropylene.

The extending surface plates 300 and 400 for extending an area of a heat transfer material are disposed between the heat exchanging bodies 200. As shown in FIGS. 6 and 10, the extended surface plates 300 and 400 have a configuration in which one plate is folded in a zigzag-form in a vertical direction, and are formed of polyethyleneterephthalate (PET) non-woven fabric. The extended surface plate 300 is formed so as to have a curvature so that corrugated surfaces 311 can be formed in a horizontal direction. And, the extended surface plate 400 is formed so as to have a plurality of surfaces 411 folded in a zigzag-form. As the extended surface plates 300 and 400, one type of the extended surface plates 300 and 400 shown in FIGS. 6 and 10 may be used, or a combination thereof may be used.

Some of the dehumidifying liquid downward supplied from the upper header 122 flow along the surfaces of the heat exchanging bodies 200, and others flow down along the extended surface plates 300 and 400. When viewed from the sides of the heat exchanging bodies 200, boundary lines 310*a* between the first inclination surfaces 310 of the extended surface plate 300 or boundary lines 410*a* between the second inclination surfaces 410 of the extended surface plate 400 are disposed to contact the heat exchanging bodies 200. More concretely, the boundary lines 310*a* and 410*a* of the first and second inclination surfaces 310 and 410, the boundary lines formed as the first and second inclination surfaces are folded in a zigzag-form in a vertical direction come in contact with the surfaces of the heat exchanging bodies 200. The first and second inclination surfaces 310 and 410 are formed to be downward inclined by a predetermined angle from the upper side to the lower side, sequentially.

As shown in FIG. 6, the first inclination surfaces 310 of the extended surface plate 300 consist of corrugated surfaces 311 in a horizontal direction. Alternatively, as shown in FIG. 10, the second inclination surfaces 410 of the extended surface plate 400 consist of a plurality of surfaces 411 folded in a zigzag-form in a horizontal direction.

Figure 7:
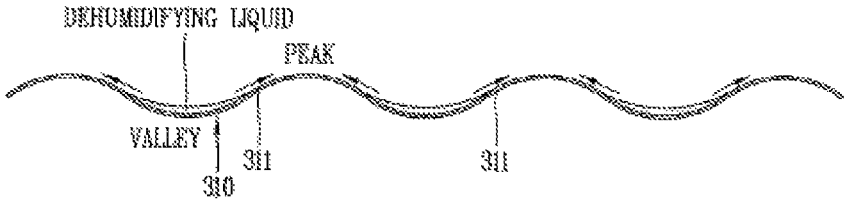
FIG. 7 is a sectional view illustrating the extended surface plate of FIG. 6.

In the former case, a dehumidifying liquid supplied from the upper side drops on an upper surface of an uppermost first inclination surface 310. Since the first inclination surface 310 consists of corrugated surfaces 311 having a plurality of valleys and peaks in a horizontal direction, the dehumidifying liquid which has dropped on the first inclination surface 310 flows down between the valleys. The dehumidifying liquid is collected in the valleys as shown in FIG. 7, and then gradually spreads to the peaks of both sides according to a capillary phenomenon. Accordingly, the dehumidifying liquid may uniformly spread onto the first inclination surface 310 which consists of the corrugated surfaces 311.

The first inclination surfaces 310 are configured to be folded in a zigzag-form in a vertical direction. Accordingly, the dehumidifying liquid which has dropped onto the uppermost first inclination surface 310 flows along the inclined surfaces. Then, the dehumidifying liquid moves toward the boundary line 310*a* of is the first inclination surface 310, and then downward flows to another first inclination surface 310 along the surfaces of the heat exchanging bodies 200.

Under this configuration, the dehumidifying liquid may uniformly spread onto the first inclination surface 310 which consists of the corrugated surfaces 311. The dehumidifying liquid which flows down along the surfaces of the heat exchanging bodies 200 along the inclined surfaces of the first inclination surfaces 310 may be cooled by heat exchange.

The dehumidifying liquid having passed through the first inclination surface 310 and a dehumidifying liquid having passed through the heat exchanging body 200 are mixed near the boundary line 310*a*, the side end portion of the first inclination surface 310. This may lower the entire temperature of the dehumidifying liquid.

When a dehumidifying liquid remains on the first inclination surface 310, the dehumidifying liquid may drop onto another first inclination surface 310 through first passing holes 321 which overlap the surface of the heat exchanging body 200. Here, the dehumidifying liquid which passes through the first passing holes 321 may downward flow along the surface of the heat exchanging body 200.

The dehumidifying liquid which remains on the other first inclination surface 310 may drop via second passing holes 322 which contact the heat exchanging body 200 and third passing holes 323 which do not contact the heat exchanging body 200.

The dehumidifying liquid may alternately move to the surfaces of the heat exchanging body 200 and the first inclination surfaces 310 of the extended surface plate 300. This may allow the dehumidifying liquids to be more smoothly mixed with each other.

In the latter case, a dehumidifying liquid supplied from the upper side drops on an upper surface of an uppermost second inclination surface 410. Since the second inclination surface 410 consists of a plurality of surfaces 411 folded in a zigzag-form in a horizontal direction, the dehumidifying liquid which has dropped on the second inclination surface 410 flows down to a valley formed between the surfaces 411. Then, the dehumidifying liquid gradually spreads to edge portions contacting the surfaces 411 according to a capillary phenomenon. Accordingly, the dehumidifying liquid may uniformly spread onto the second inclination surface 410 which consists of the plurality of surfaces 411 in a horizontal direction.

The second inclination surfaces 410 are configured to be folded in a zigzag-form in a vertical direction. Accordingly, the dehumidifying liquid which has dropped onto the uppermost second inclination surface 410 flows along the inclined surfaces. Then, the dehumidifying liquid moves toward the boundary line 410*a* of the second inclination surface 410, and then downward flows to another second inclination surface 410 along the surfaces of the heat exchanging bodies 200.

Under this configuration, the dehumidifying liquid may uniformly spread onto the second inclination surface 410 which consists of the surfaces 411. The dehumidifying liquid which flows down along the surfaces of the heat exchanging bodies 200 along the inclined surfaces of the second inclination surfaces 410 may to be cooled by heat exchange.

The dehumidifying liquid having passed through the second inclination surface 410 and a dehumidifying liquid having passed through the heat exchanging body 200 are mixed near the boundary line 410*a*, the side end portion of the second inclination surface 410. This may lower the entire temperature of the dehumidifying liquid.

When a dehumidifying liquid remains on the second inclination surface 410, the dehumidifying liquid may downward flow through first passing holes 421, second passing holes 422 and third passing holes 423. Here, the first, second and third passing holes 421, 422 and 423 may have the same operation as the aforementioned first, second and third passing holes 321, 322 and 323.

Figure 14:
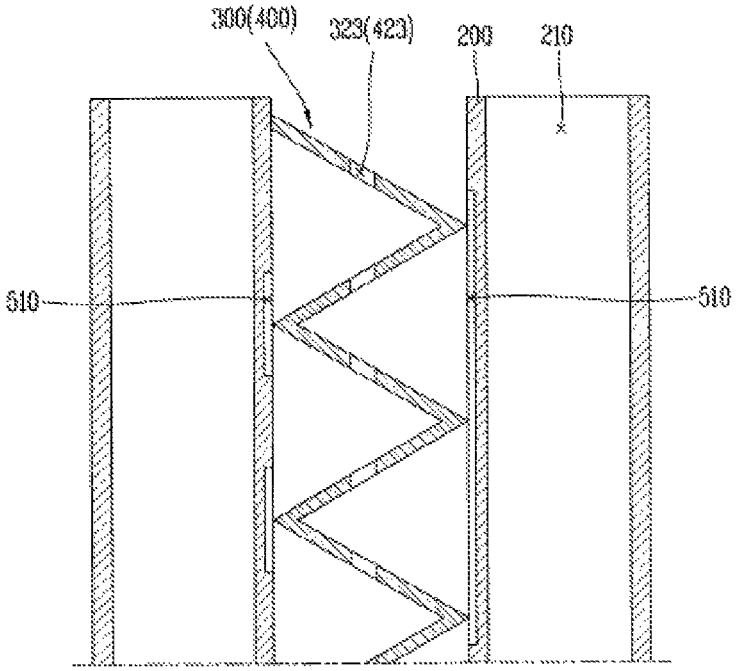
FIG. 14 is a sectional view illustrating that channels are formed on a surface of a heat exchanger body according to the present invention.

A plurality of flow paths 210 may be formed in the heat exchanging bodies 200 so that a heat transfer medium can flow therethrough. A plurality of channels 510 (FIG. 14) having different lengths are formed on the surfaces of the heat exchanging bodies 200. The channel 510 has a rectangular section, and is extending in upper and lower directions of the heat exchanging body 200. The channel 510 may have various lengths. Here, the section of the channel 510 is not limited to the rectangular shape, but may include a circular shape or other polygonal shape.

The plurality of channels 510 are disposed on the heat exchanging bodies 200 in parallel in a width direction. More concretely, the plurality of channels 510 are formed along the boundary lines 310*a* of the first inclination surfaces 310 of the extended surface plate 300 (refer to FIG. 6) or along the boundary lines 410*a* of the second inclination surfaces 410 of the extended surface plate 400 (refer to FIG. 10), the boundary lines formed in a horizontal direction.

The channels 510 may be extending by a predetermined length so that the boundary lines 310*a* of the first inclination surfaces 310 or the boundary lines 410*a* of the second inclination surfaces 410 folded in a zigzag-form in a vertical direction of the heat exchanging bodies 200 are connected to each other. Here, the channels 510 may be extending consecutively or inconsecutively.

Under the configuration of the channels, a dehumidifying liquid supplied from the upper side of the extended surface plates 300 and 400 flows along the uppermost first and second inclination surfaces 310 and 410, and then downward flows via the passing holes 320 and 420. Alternatively, the dehumidifying liquid downward flows along the surfaces of the heat exchanging bodies 200.

Here, the dehumidifying liquid which flows along the surfaces of the heat exchanging bodies 200 flows to the lower surfaces of the heat exchanging bodies 200 through the channels 510.

Preferably, a lower end of the channel 510 is positioned between the first inclination surfaces 310 or between the second inclination surfaces 410. Under this configuration, the dehumidifying liquid may be discharged from the channels 510 to come in uniform contact with the surfaces of the heat exchanging bodies 200. This may enhance heat exchanging efficiency.

Alternatively, the lower end of the channel 510 may be downward inclined with respect to an inner wall. In this case, the dehumidifying liquid introduced into the channels 510 may easily flow down along the surfaces of the heat exchanging bodies 200.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A heat exchanger having an extended surface plate, the heat exchanger comprising:

a plurality of heat exchanging bodies having therein flow paths along which a heat transfer medium flows; and extended surface plates, each disposed to contact facing surfaces of the heat exchanging bodies, and configured to allow a dehumidifying liquid supplied between the heat exchanging bodies to flow therealong, wherein when a supply direction of the dehumidifying liquid is a vertical direction, the extended surface plate has a zigzag-form in the vertical direction, and has a plurality of bending portions in a horizontal direction, and the extended surface plate comprises at least one of a corrugated form and a zigzag form in the horizontal direction.

2. The heat exchanger having an extended surface plate of claim 1, wherein the extended surface plate comprises the corrugated form in the horizontal direction.

3. The heat exchanger having an extended surface plate of claim 1, wherein the extended surface plate comprises the zigzag form in the horizontal direction.

4. The heat exchanger having an extended surface plate of claim 1, wherein the extended surface plate is formed of nonwoven fabric.

5. The heat exchanger having an extended surface plate of claim 4, wherein the extended surface plate is formed of polyethyleneterephthalate (PET) nonwoven fabric.

6. The heat exchanger having an extended surface plate of claim 1, wherein the heat exchanging bodies undergo a surface processing for enhanced wet property.

7. The heat exchanger having an extended surface plate of claim 1, wherein a surface of the extended surface plate undergoes hydrophilic coating.

8. The heat exchanger having an extended surface plate of claim 1, wherein the extended surface plate is provided with a plurality of passing holes through which a dehumidifying liquid flows down, the dehumidifying liquid supplied from an upper side and flowing along a plurality of inclination surfaces repeatedly formed in the horizontal and the vertical directions.

9. The heat exchanger having an extended surface plate of claim 8, wherein at least one of the passing holes is formed on a bottom surface of a bending portion.

* * * * *